US007247605B2

(12) United States Patent
Burns

(10) Patent No.: US 7,247,605 B2
(45) Date of Patent: Jul. 24, 2007

(54) SOLUBILITY OF PERFLUORINATED POLYETHERS IN FLUORINATED SOLVENTS

(75) Inventor: John Martin Burns, Morgan Hill, CA (US)

(73) Assignee: Hitachi Global Storage Technologies Netherlands B.V., Amsterdam (NL)

( * ) Notice: Subject to any disclaimer, the term of this patent is extended or adjusted under 35 U.S.C. 154(b) by 366 days.

(21) Appl. No.: 10/693,176

(22) Filed: Oct. 24, 2003

(65) Prior Publication Data

US 2005/0090408 A1 Apr. 28, 2005

(51) Int. Cl.
*C10M 129/20* (2006.01)
*C10M 131/10* (2006.01)

(52) U.S. Cl. ..... 508/307; 508/304; 508/582

(58) Field of Classification Search ..... 508/304, 508/307, 582

See application file for complete search history.

(56) References Cited

U.S. PATENT DOCUMENTS 3,242,218 A 3/1966 Miller
3,665,041 A 5/1972 Sianesi
3,715,378 A 2/1973 Sianesi et al.
4,267,238 A 5/1981 Chernega
4,268,556 A 5/1981 Pedrotty
4,597,882 A * 7/1986 Nishimura et al. ..... 508/111
4,721,795 A 1/1988 Caporiccio et al.
5,116,685 A * 5/1992 Karle et al. ..... 428/425.9
5,292,585 A * 3/1994 Ohnuki et al. ..... 428/336
5,498,359 A * 3/1996 Shinomoto et al. ..... 508/207
5,663,127 A 9/1997 Flynn et al.
6,093,495 A 7/2000 Falcone
6,486,103 B1 * 11/2002 Burdzy et al. ..... 508/582
2002/0090536 A1 7/2002 Dai et al.

* cited by examiner

*Primary Examiner*—Vasu Jagannathan
*Assistant Examiner*—Vickey Ronesi
(74) *Attorney, Agent, or Firm*—Mintz, Levin, Cohn, Ferris, Glovsky and Popeo, P.C.

(57) ABSTRACT

Methods of improving the solubility of highly functionalized polar perfluorinated polyethers in fluorinated solvents are described. In preferred embodiments, the ratio of solubilizer to fluorinated solvent is the azeotropic ratio. The solubilizer can be an alcohol or cyclic ether. The methods finds utility in hard disc drive applications, where perfluorinated polyethers are used as lubricants. Compositions are also provided.

9 Claims, No Drawings

SOLUBILITY OF PERFLUORINATED POLYETHERS IN FLUORINATED SOLVENTS

FIELD OF THE INVENTION

This invention relates to improving the solubility of perfluorinated polyethers in fluorinated solvents used in hard disc drive applications. More particularly, the invention relates to the addition of an alcohol or a cyclic ether to a non-polar fluorinated solvent to improve the solubility of polar perfluorinated polyethers therein.

BACKGROUND OF THE INVENTION

Highly functionalized, polar perfluorinated polyethers ("PFPE") are currently used as lubricants in a variety of high-performance applications, for example to lubricate hard disc drive ("HDD") media, as well as to lubricate precision mechanical instruments to minimize mechanical wear. PFPEs also function as anti-wetting and/or corrosion-protective agents on metal-containing substrates, particularly in magnetic recording devices such as magnetic recording disks and magnetic recording heads. See, for example, U.S. Patent Publication No. 2002/0090536 to Dai et al., which describes novel metal salts of perfluorinated polyethers.

One of the most widely used lubricants is Fomblin®Z-Tetraol, a tetra-hydroxyl functionalized PFPE (Solvay Solexis, Inc.). Unfortunately, PFPEs tend to have poor solubility in relatively non-polar fluorinated solvents, which are commonly used as the lube bath solvents for deposition of functionalized PFPEs on disks for HDD applications. Even at low concentrations, a Fomblin®Z-Tetraol solution in a hydrofluorocarbon or hydrofluoroether solvent, is found to be cloudy and turbid due to the poor solubility of the PFPE lubricant in the fluorinated solvents.

U.S. Pat. No. 5,663,127 to Flynn et al., describes the use of perfluorinated non-aromatic cyclic solvents as replacements for the non-polar fluorinated solvents, as one means of improving the dissolution properties of functionalized, polar PFPEs. However, such heterocyclic solvents can be costly.

To develop a lubricant that does not use conventional PFPEs, which are only soluble in fluorinated solvents, U.S. Pat. No. 6,093,495 to Falcone describes a water-soluble salt of a perfluoro polyether alcohol which is readily soluble in aqueous solvents.

Therefore, in spite of the advances in the art, there is a continuing need to develop improved methods of functionalized PFPE deposition for HDD applications. The present invention addresses those needs by improving the solubility of PFPEs in lube bath solvents using an alcohol or cyclic ether.

SUMMARY OF THE INVENTION

One aspect of the invention relates to a method of improving the solubility of perfluorinated polyethers in fluorinated solvents, comprising adding a solubilizer to the solvent, wherein the solubilizer is selected from alcohols and cyclic ethers.

Another aspect of the invention pertains a method of dissolving a perfluorinated polyether for use in hard disk drive applications, comprising: (a) providing a fluorinated solvent; and (b) adding a solubilizer and a perfluorinated polyether to the solvent, wherein the solubilizer is selected from alcohols and cyclic ethers.

Yet another aspect of the invention relates to a lubricating composition comprising a perfluorinated polyether, a fluorinated solvent and a solubilizer selected from alcohols and cyclic ethers. The lubricating composition finds utility in hard disc drive applications.

Still another aspect of the invention relates to a method of manufacturing a corrosion-protected magnetic storage device, comprising: (a) forming a magnetic layer on a substrate; (b) forming a protective overcoat layer over the magnetic layer; and (c) forming a lubricant topcoat on the surface of the protective overcoat layer by directly applying to said surface a solution consisting of: (i) a fluorinated solvent, (ii) a solubilizer, and (iii) a perfluorinated polyether dissolved therein; wherein the solubilizer is selected from alcohols and cyclic ethers.

DETAILED DESCRIPTION OF THE INVENTION

The definitions set forth herein apply only to the terms as they are used in this patent and may not be applicable to the same terms as used elsewhere, for example in scientific literature or other patents or applications including other applications by these inventors or assigned to common owners. The following description of the preferred embodiments and examples are provided by way of explanation and illustration. As such, they are not to be viewed as limiting the scope of the invention as defined by the claims. Additionally, when examples are given, they are intended to be exemplary only and not to be restrictive. For example, when an example is said to "include" a specific feature, that is intended to imply that it may have that feature but not that such examples are limited to those that include that feature.

It must be noted that, as used in this specification and the appended claims, the singular forms "a", "an" and "the" include plural referents unless the context clearly dictates otherwise. Thus, for example, reference to "a solvent" includes a mixture of two or more such solvents, "a PFPE" includes a mixture of two or more such PFPEs, and the like.

The present invention relates to methods of improving the solubility of highly functionalized polar perfluorinated polyethers in non-polar fluorinated solvents by the addition of an alcohol or cyclic ether solubilizer, to provide lubricating compositions.

Perfluorinated Polyethers

Perfluorinated polyethers polymers are fluorinated oligomers, homopolymers and copolymers of polyethers. Suitable perfluorinated polyethers include commercially available highly functionalized polar perfluorinated polyethers ("PFPE") such as Fomblin®Z-Tetraol (Solvay Solexis Inc.). Other PFPEs are well known and described in the literature. See for example, U.S. Pat. No. 3,242,218 to Miller; U.S. Pat. No. 3,665,041 to Sianesi; U.S. Pat. No. 3,715,378 to Sianesi et al.; U.S. Pat. No. 4,268,556 to Pedrotty; U.S. Pat. No. 4,267,238 to Chernega; U.S. Pat. No. 4,721,795 to Caporiccio et al.; and U.S. Pat. No. 5,663,127 to Flynn et al. The term "perfluorinated polyether" is also intended to include non-functionalized polar PFPEs that are purchased and functionalized prior to use. These include PFPEs such as those sold under the brand names Krytox® (DuPont Specialty Chemicals, Deepwater, N.J.), Demnum® (Daikin Kogyo Co., Ltd., Japan), and other PFPEs sold under the Fomblin® Z name.

The PFPEs described in U.S. Pat. No. 5,663,127 to Flynn et al. are particularly well suited for, and benefit from, use in the methods of the instant invention. They are described therein as being perfluoropolyether compounds represented by the formula:

$$A[—(C_yF_{2y})—O—(C_4F_8O)_k—(C_3F_6O)_m—(C_2F_4O)_n—(CF_2O)_p—(C_zF_{2z})—]A'$$

The terminal A and A' moieties are monovalent organic groups such as $—CF_2CF_3$, $—CF_3$, —F, $—OCF_2CF_3$, $—OCF_3$, $—CF_2C(O)F$, —C(O)F, alkyl, aryl and alkylaryl groups. The integers y and z can range from 0–20, while the integers k, m, n, and p can range from 0–200, with the sum of k, m, n, and p typically being 2–200. The repeating units can be randomly distributed in the backbone of the compound. The end groups $C_yF_{2y}$ and $C_zF_{2z}$, and the internal groups $C_4F_8O$, $C_3F_6O$, and $C_2F_4O$, can all be linear or branched.

Other PFPEs that can benefit from the methods of the invention are described below.

Krytox® has the structure: $F_3C—CF_2—CF_2—O—[CF(CF_3)—CF_2—O]_m—CF_2—CF_3$, where m is about 4 or 5, and is synthesized by base-catalyzed polymerization of hexafluoropropylene oxide, as described by Gumbrecht, *ASLE Trans.* 9:24 (1966). The hydrogen atoms in the resulting polymer is then replaced by fluorine atoms by subsequent contact with $F_2$ in solution, as described by Ohsaka, *Petrotech* (*Tokyo*) 8:840 (1985).

Demnum® has the structure: $F_3C—CF_2—CF_2—O—[CF_2—CF_2—O]_m—CF_2—CF_3$, where m is about 4 or 5, and is made in a manner similar to that for Krytox®, but starting with 2,2,3,3-tetrafluorooxetane.

Fomblin® Z has the structure: $F_3C—O[CF_2—CF_2—O]_m[CF_2—O]_n—CF_3$, where m and n are about 4 or 5, and is synthesized by photooxidation of tetrafluoroethylene and is a linear, random copolymer of ethylene oxide and methylene oxide units; see Sianesi, *Chim. Ind.* 55:208 (1973).

These PFPEs are also available with carboxylic acid end groups, as exemplified by Krytox®-H, Demnum®-SH, and Fomblin® Z-DIAC.

Fluorinated Solvents

Fluorinated solvents are fluorinated hydrocarbons, typically compounds having a carbon backbone that has been substituted with one or more fluorine atoms. The backbone can be straight, branched, or cyclic. The backbone may also be substituted with other halogen atoms such as chlorine, bromine and iodine. The backbone can consist entirely of carbon atoms or may have one or more heteroatoms such as —O—, —NR— (where R can be H or a functional group such as alkyl), —S—, and so forth.

In general, fluorinated solvents useful in the methods of the invention include, by way of illustration and not limitation, relatively non-polar solvents such as hydrochlorofluorocarbons ("HCFC"), hydrofluoroethers ("HFE"), hydrofluorocarbons ("HFC"), hydrohalofluoroethers ("HHFE"), fluorinated amines and cyclic ethers.

Examples of HCFCs include chlorofluoroalkanes such as dichloropentafluoropropanes (e.g., 2,3-dichloro-1,1,1,3-3-pentafluoropropane); trichlorotrifluoroethanes (e.g., 1,1,2-trichloro-1,2,2-trifluoroethane); and dichlorotrifluoroethanes (1,1-dichloro-2,2,2-trifluoroethane, 1,1-dichloro-1,2,2-trifluoroethane and 1,2-dichloro-1,1,2-trifluoroethane).

HFEs are also referred to as highly fluorinated ethers, and are generally fluorinated hydrocarbons where the carbon backbone includes at least one —O— heteratom. Examples of HFEs include, mono-, di-, tri-, and poly-alkoxy-substituted perfluoroalkanes and α-, β-, and ω-substituted hydrofluoroalkyl ethers. Specific examples include the hydrofluoroether, methoxynonafluorobutane, and isomeric mixtures thereof.

HFCs are generally fluorinated hydrocarbons where the carbon backbone consists entirely of carbon atoms, or does not contain an —O— heteroatom. Examples of HFCs include, linear and branched hydrofluorobutanes, hydrofluoropentanes, hydrofluorohexanes, hydrofluoroheptanes, as well as and fluorinated cyclopentanes. Numerous HFCs are commercially available, for example, under the names Vertrel® (E. I. DuPont de Nemours, Wilmington, Del.) and Zeorora-H® (Nippon Zeon, Tokyo, Japan).

Examples of fluorinated amines and fluorinated cyclic ethers include, perfluoro-4-methylmorpholine, perfluorotriethylamine, perfluoro-2-ethyltetrahydrofuran, perfluoro-2-butyltetrahydrofuran, perfluoro-4-isopropylmorpholine, perfluorodibutyl ether, perfluorotripropylamine, perfluorotributylamine, perfluorodihexyl ether, perfluoro[2-(diethylamino)ethyl-2-(N-morpholino) ethyl] ether, and n-perfluorotetradecahydrophenanthrene.

HHFEs are generally fluorinated ethers where the carbon backbone also has been substituted with one or more non-fluorine halogen atoms. Examples of HHFEs include perfluoroalkylhaloethers.

Alcohols and Cyclic Ethers

Suitable alcohols useful in the methods of the invention include by way of illustration and not limitation, lower alcohols such as methanol, ethanol, propanol, isopropanol, and butanol; halogenated alcohols such as trifluoroethanol, pentafluoropropanol and heptafluorobutanol. In a preferred embodiment, lower alcohols are used.

Suitable cyclic ethers can either be saturated or unsaturated and will typically not contain any fluorine atoms. Exemplary cyclic ethers include by way of illustration and not limitation, tetrahydrofuran, 2-methyl-tetrahydrofuran, furan, tetrahydropyran, pyran, and dioxane. Saturated cyclic ethers such as tetrahydrofuran, 2-methyl-tetrahydrofuran, tetrahydropyran, and dioxane are preferred.

Compositions

The invention relates to lubricating compositions comprised of a perfluorinated polyether, a fluorinated solvent and a solubilizer selected from alcohols and cyclic ethers. Even at low concentrations, PFPE solutions in fluorinated solvents are cloudy and turbid due to the poor solubility of the PFPE. Addition of an alcohol or cyclic ether solubilizer as set forth herein, increases the PFPE solubility, thus eliminating the cloudiness and turbidity.

One skilled in the art can readily ascertain solubilizer-to-solvent ratios that are suited for the particular solubilizer, solvent and PFPE used, and typically, the weight ratio of solubilizer to fluorinated solvent is expected to fall within the range of about 2:98 to 10:90. In preferred embodiments, the weight ratio of solubilizer to fluorinated solvent is set so as to provide an azeotropic ratio, which will also typically be within the 2:98 to 10:90 range.

Azeotropes are blends of materials and have a constant boiling point, i.e., irrespective of the boiling points of the individual materials, when combined both materials will boil at the same temperature. Therefore, at the azeotropic ratio of solvents, the composition does not change upon distillation, i.e. the solvent mix evaporates at the same ratio as the liquid bath. In that manner, if a mixture containing x % of a fluorinated solvent and y % of a solubilizer is heated to boiling, the fumes would also contain, x % of the fluorinated solvent and y % of the solubilizer. Thus, azeotropes are preferred since the bath composition remains constant during the process. In addition, azeotropes provide an economical advantage, since they are readily distilled and recovered.

As for the weight ratio of the PFPE to the fluorinated solvent/solubilizer mixture, typically this will be within the range of about 0.001–10 parts of PFPE to about 90–99.999 parts of the solvent/solubilizer mixture, and preferably within the range of about 0.001–0.1 parts PFPE to 99.9–99.999 parts solvent/solubilizer mixture.

Methods of Use

One embodiment of the invention is a method of improving the solubility of perfluorinated polyethers in fluorinated solvents, comprising adding a solubilizer to the solvent, wherein the solubilizer is selected from alcohols and cyclic ethers. The solubilizer can be added to the fluorinated solvent before, after or simultaneous with adding the PFPE. In addition, fluorinated solvent-solubilizer solutions are commercially available. These can also be used in the methods of the invention and include HFE-71IPA (3M Specialty Materials, St. Paul, Minn.) and Vertrel® Azeotropic solvents (E. I. DuPont de Nemours). HFE-71IPA is a particularly preferred azeotrope-like formulation that contains a hydrofluoroether isomeric mixture of methylnonafluorobuytlether and methylnonafluoroisobutylether ($C_4F_9OCH_3$), in isopropanol.

Another embodiment of the invention is a method of dissolving a perfluorinated polyether for use in hard disk drive applications, comprising: (a) providing a fluorinated solvent; and (b) adding a solubilizer and a perfluorinated polyether to the solvent; wherein the solubilizer is selected from alcohols and cyclic ethers. There are several ways that this method can be accomplished within the scope of the invention.

In a preferred embodiment, the solubilizer is first added to the solvent, followed by the addition of the perfluorinated polyether. However, in another embodiment, the perfluorinated polyether is first added to the solvent, followed by the addition of the solubilizer. Yet another embodiment involves the simultaneous addition of the solubilizer and the perfluorinated polyether to the solvent.

The present compositions find utility as corrosion-protective lubricant layers in magnetic storage devices such as magnetic storage disks and magnetic recording heads. Accordingly, another embodiment of the invention pertains to a method of manufacturing a corrosion-protected magnetic storage device, comprising: (a) forming a magnetic layer on a substrate; (b) forming a protective overcoat layer over the magnetic layer; and (c) forming a lubricant topcoat on the surface of the protective overcoat layer by directly applying to said surface a solution consisting of: (i) a fluorinated solvent, (ii) a solubilizer, and (iii) a perfluorinated polyether dissolved therein; wherein the solubilizer is selected from alcohols and cyclic ethers. A corrosion-protected magnetic storage device can thus be produced by the method of the invention wherein a lubricant topcoat is applied as a solution of the fluorinated solvent, a solubilizer, and a perfluorinated polyether, and dried, as by heating.

Exemplary magnetic recording devices are described in U.S. Publication No. 2002/0090536 to Dai et al. The substrate is typically of a metal or metal oxide material. The protective overcoat layer is commonly an overcoat of essentially amorphous carbon, as described for example, in U.S. Pat. No. 5,030,494 to Ahlert et al. and U.S. Pat. No. 5,075,287 to Doemer et al.

As described in the aforementioned patents, many rotating rigid disk drives include read/write transducers (or "heads") supported on a carrier (or "slider") that ride on a cushion or bearing of air above the surface of a magnetic recording disk when the disk is rotating at operating speed. The slider has an air-bearing surface ("ABS"), typically in the form of a plurality of rails, and is connected to a linear or rotary actuator by means of a suspension. There may be a stack of disks in the disk drive with the actuator supporting a number of sliders. The actuator moves the sliders radially so that each head may access the recording area of its associated disk surface. The slider in the disk drive is biased toward the disk surface by a small force from the suspension. The ABS of the slider is thus in contact with the disk surface from the time the disk drive is turned on until the disk reaches a speed sufficient to cause the slider to ride on the air bearing. The ABS of the slider is again in contact with the disk surface when the disk drive is turned off and the rotational speed of the disk fails below that necessary to create the air bearing. This type of disk drive is called a contact start/stop (CSS) disk drive. To provide wear resistance for the ABS in a CSS disk drive, a protective carbon overcoat may be placed on the slider rails. U.S. Pat. No. 5,159,508 to Grill et al., describes a slider with air-bearing rails having an amorphous carbon overcoat that is adhered to the rails by a silicon adhesion layer.

The magnetic recording disk in a CSS rigid disk drive is typically a thin film disk comprising a substrate, such as a disk blank made of glass, ceramic, glassy carbon or an aluminum-magnesium alloy with a nickel-phosphorous (NiP) surface coating, and a cobalt-based magnetic alloy film formed by sputter deposition over the substrate. A protective overcoat, such as a sputter-deposited amorphous carbon film, is formed over the magnetic layer to provide corrosion resistance and wear resistance from the ABS of the slider. The overcoat may further include relatively small amounts of embedded iron, tungsten or tungsten carbide to improve wear resistance and minimize the likelihood of damage to disk file components. Such overcoats are typically formed by sputter deposition from a graphite target, and are generally called protective carbon overcoats, "diamondlike" carbon overcoats, amorphous carbon overcoats, or, in the case of those overcoats formed by sputter deposition in the presence of a hydrogen-containing gas, hydrogenated carbon overcoats. In addition to the magnetic layer and the protective overcoat, the thin film disk may also include a sputter-deposited underlayer, such as a layer of chromium or a chromium-vanadium alloy, between the substrate and the magnetic layer, and a sputter-deposited adhesion layer, such as a Cr, tungsten or titanium layer, between the magnetic layer and the protective overcoat.

EXAMPLES

The following examples are put forth so as to provide those of ordinary skill in the art with a complete disclosure and description of how to make and use the compositions/compound/methods of the invention. Efforts have been made to ensure accuracy with respect to numbers (e.g., amounts, temperature, etc.) but some experimental error and deviations should, of course, be allowed for. Unless indicated otherwise, parts are parts by weight, temperature is degrees centigrade and pressure is at or near atmospheric. All components were obtained commercially unless otherwise indicated.

Example 1

To a solution of a mixture of methylnonafluorobuytlether and methylnonafluoroisobutylether isomers (HFE-7100; 3M Specialty Materials) is added isopropanol in an amount to produce a 5 wt % alcohol mixture. Alternately, a premixed 5 wt % isopropanol/isomer mix, commercially available as HFE-71IPA (3M Specialty Materials) can also be used. 0.1 wt % of the perfluoropolyether, Fomblin®Z-Tetraol (a functionalized perfluoropolyether having a number average molecular weight of 1000–4500 and a polydispersity greater than about 1.5; Solvay Solexis Inc.) is then added and dissolved via agitation.

Example 2

A 5 wt % methanol solution is made using a mixture of methylnonafluorobuytlether and methylnonafluoroisobutylether isomers (HFE-7100). 1 wt % Fomblin®Z-Tetraol is then added and dissolved via agitation.

All patents, publications, and other published documents mentioned or referred to herein are incorporated by reference in their entireties.

It is to be understood that while the invention has been described in conjunction with the preferred specific embodiments thereof, that the foregoing description as well as the examples, are intended to illustrate and not limit the scope of the invention. It should be understood by those skilled in the art that various changes may be made and equivalents may be substituted without departing from the scope of the invention, and further that other aspects, advantages and modifications will be apparent to those skilled in the art to which the invention pertains.

I claim:

1. A method of improving the solubility of perfluorinated polyethers in fluorinated solvents, comprising combining a perfluorinated polyether with a solubilizer and a fluorinated solvent to form a solution, wherein the solubilizer is selected from the group consisting of tetrahydrofuran, 2-methyl-tetrahydrofuran, tetrahydropyran, and dioxane, and wherein the solution comprises about 0.001–1 parts by weight of perfluorinated polyether to about 99–99.999 parts by weight of the solvent and solubilizer combined, and further wherein the weight ratio of solubilizer to fluorinated solvent is either about the azeotropic ratio or within the range of about 2:98 to 10:90, or is both about the azeotropic ratio and within the range of about 2:98 to 10:90.

2. The method of claim 1, wherein the solution is formed by first adding the solubilizer to the solvent, followed by the addition of the perfluorinated polyether.

3. The method of claim 1, wherein the solution is formed by first adding the perfluorinated polyether to the solvent, followed by the addition of the solubilizer.

4. The method of claim 1, wherein the solution is formed by simultaneously adding the solubilizer and the perfluorinated polyether to the solvent.

5. The method of claim 1, wherein the fluorinated solvent is selected from the group consisting of hydrochlorofluorocarbons, hydrofluoroethers, hydrofluorocarbons, hydrohalofluoroethers, fluorinated amines, and fluorinated cyclic ethers.

6. A method of dissolving a perfluorinated polyether for use in hard disk drive applications, comprising:

(a) providing a fluorinated solvent; and (b) adding a solubilizer and a perfluorinated polyether to the solvent;

wherein the solubilizer is a cyclic ether selected from the group consisting of tetrahydrofuran, 2-methyl-tetrahydrofuran, tetrahydropyran, and dioxane, and wherein the solution comprises about 0.001–1 parts by weight of perfluorinated polyether to about 99–99.999 parts by weight of the solvent and solubilizer combined, and further wherein the weight ratio of solubilizer to fluorinated solvent is either within the range of about 2:98 to 10:90 or is about the azeotropic ratio, or is both about the azeotropic ratio and within the range of about 2:98 to 10:90.

7. The method of claim 6, wherein the solubilizer is first added to the solvent, followed by the addition of the perfluorinated polyether.

8. The method of claim 6, wherein the perfluorinated polyether is first added to the solvent, followed by the addition of the solubilizer.

9. The method of claim 6, wherein the solubilizer and the perfluorinated polyether are added simultaneously to the solvent.

* * * * *